US007603745B2

(12) United States Patent
Frederickson

(10) Patent No.: US 7,603,745 B2
(45) Date of Patent: Oct. 20, 2009

(54) CLEANER HEAD FOR A CLEANING APPLIANCE

(75) Inventor: Clive James Frederickson, Wiltshire (GB)

(73) Assignee: Dyson Technology Limited, Wiltshire (GB)

( * ) Notice: Subject to any disclaimer, the term of this patent is extended or adjusted under 35 U.S.C. 154(b) by 84 days.

(21) Appl. No.: 11/794,979

(22) PCT Filed: Jan. 9, 2006

(86) PCT No.: PCT/GB2006/000061

§ 371 (c)(1),
(2), (4) Date: Jul. 10, 2007

(87) PCT Pub. No.: WO2006/077377

PCT Pub. Date: Jul. 27, 2006

(65) Prior Publication Data

US 2008/0000043 A1 Jan. 3, 2008

(30) Foreign Application Priority Data

Jan. 18, 2005 (GB) ..... 0500990.7

(51) Int. Cl.
*A47L 5/30* (2006.01)

(52) U.S. Cl. ..... 15/319; 15/377; 15/DIG. 10

(58) Field of Classification Search ..... 15/319, 15/377, DIG. 10; *A47L 5/30*
See application file for complete search history.

(56) References Cited

U.S. PATENT DOCUMENTS

| | | | |
|---|---|---|---|
| 4,099,291 | A | 7/1978 | Bowerman |
| 4,987,637 | A | 1/1991 | Zummer et al. |
| 6,351,872 | B1 | 3/2002 | McCormick |
| 2002/0124346 | A1 | 9/2002 | Steiner et al. |
| 2004/0134014 | A1 | 7/2004 | Hawkins et al. |

FOREIGN PATENT DOCUMENTS

| | | |
|---|---|---|
| EP | 0 437 734 | 7/1991 |
| GB | 2 401 309 | 11/2004 |
| GB | 2 402 608 | 12/2004 |

OTHER PUBLICATIONS

UK Search Report dated Apr. 21, 2005, directed at counterpart GB application No. 0500990.7.

*Primary Examiner*—David A Redding
(74) *Attorney, Agent, or Firm*—Morrison & Foerster LLP

(57) ABSTRACT

A cleaner head for a cleaning appliance includes a dirt and dust separating apparatus, a motor configured to drive a fan for generating suction air flow and a selectively-operable switch for energizing the motor and cleaner head. The cleaner head has a drivable agitator in the form of a brush bar and a dedicated motor. When the main vacuum motor is switched on, the brush bar motor is energized so that the brush bar is automatically driven on start-up of the cleaner. This enables the superior cleaning performance achievable with a brush bar to be automatically achieved, without the user having to remember to select operation of the brush bar.

15 Claims, 3 Drawing Sheets

CLEANER HEAD FOR A CLEANING APPLIANCE

REFERENCE TO RELATED APPLICATIONS

This application is a national stage application under 35 USC 371 of International Application No. PCT/GB2006/000061, filed Jan. 9, 2006, which claims the priority of United Kingdom Application No. 0500990.7, filed Jan. 18, 2005, the contents of both of which prior applications are incorporated herein by reference.

FIELD OF THE INVENTION

This invention relates to a cleaner head for a cleaning appliance, such as a vacuum cleaner.

BACKGROUND OF THE INVENTION

The majority of vacuum cleaners are either of the 'upright' type or of the 'cylinder' type, called canister or barrel cleaners in some countries. An upright vacuum cleaner normally comprises a main body containing dirt and dust separating apparatus, a cleaner head rotatably mounted on the main body and having a dirty air inlet, and a motor and fan unit for drawing dirty air into the dirt and dust separating apparatus via the dirty air inlet so that dirt and dust can be separated from the airflow before the clean air is expelled to the atmosphere. The dirty-air inlet through which dirty air is sucked into the vacuum cleaner is directed downwardly so that it faces the floor to be cleaned. The dirt and dust separating apparatus can take the form of a filter bag or, as is known, can alternatively take the form of a cyclonic arrangement. The present invention is not concerned with the nature of the dirt and dust separating apparatus and is therefore applicable to vacuum cleaners utilising either arrangement.

An agitator in the form of, for example, a brush bar is supported in the dirty-air inlet so that it protrudes to a small extent from the inlet. The brush bar typically comprises an elongate cylindrical core from which bristles extend along its length in a radial direction. The brush bar is driven by a motor, typically via a drive belt, so that the brush bar rotates within the inlet. Rotation of the brush bar causes the bristles to flick dirt and debris from the fibres of the carpet to be cleaned. The suction of air causes air to flow around the brush bar and underneath it to help lift the dirt and dust from the surface to be cleaned and then carry it from the dirty-air inlet to the dirt and dust separating apparatus. Use of the agitator when cleaning a carpeted surface provides a superior cleaning performance than if an agitator is not used.

SUMMARY OF THE INVENTION

A first embodiment of the invention provides a cleaner head for a cleaning appliance comprising dirt and dust separating means, a motor arranged to drive a fan for generating suction air flow and a selectively-operable switch for energising the motor, the cleaner head comprising a driveable agitator arranged so that, when a user switches on the motor, the agitator is automatically driven.

A second embodiment of the invention provides a cleaning appliance comprising a main body housing dirt and dust separating means, a motor arranged to drive a fan for generating suction air flow, a selectively-operable switch for energising the motor and a cleaner head having a driveable agitator arranged so that, when a user switches on the motor, the agitator is automatically driven.

A further embodiment of the invention provides control circuitry for a cleaning appliance comprising dirt and dust separating means, a motor arranged to drive a fan for generating suction air flow and a cleaner head having a driveable agitator, the circuitry comprising a user-operable switch for energising the motor and arranged so that, when a user switches on the motor, the agitator is automatically driven.

It has been found with conventional cleaners that users tend to forget to employ the agitator on restarting their appliance, thereby missing out on the best cleaning performance. The invention prevents this from happening by causing the agitator automatically to be driven on start-up of the main vacuum motor. The user does not have to remember to select operation of the agitator when using the cleaner.

Preferably, the agitator is driven by its own dedicated motor, which may be located on the cleaner head.

A switch for the agitator motor may be provided, so that the agitator motor can be de-energised if the user wishes to, say, clean an uncarpeted surface. The agitator motor may subsequently be re-energised for cleaning of carpeted surfaces.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 1:
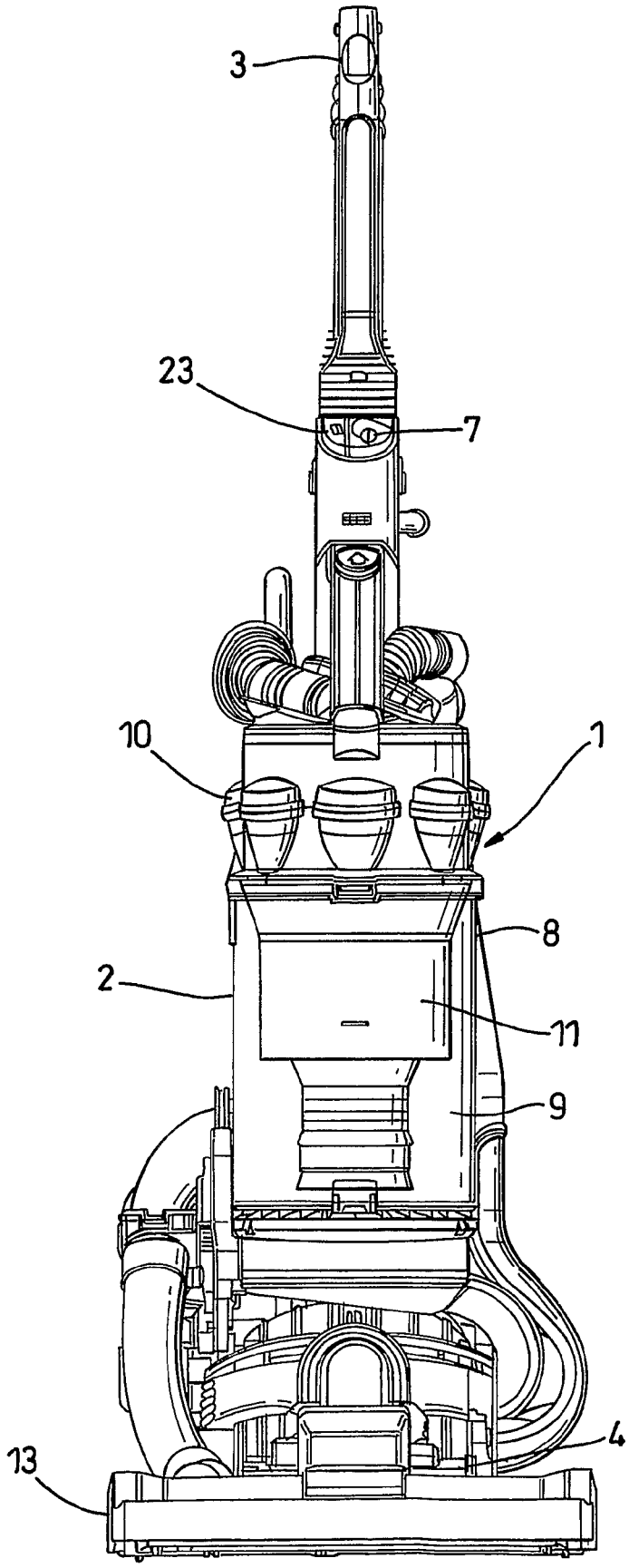
FIG. 1 is a front view of a surface treating appliance constructed in accordance with the first embodiment of the invention.
Figure 3:
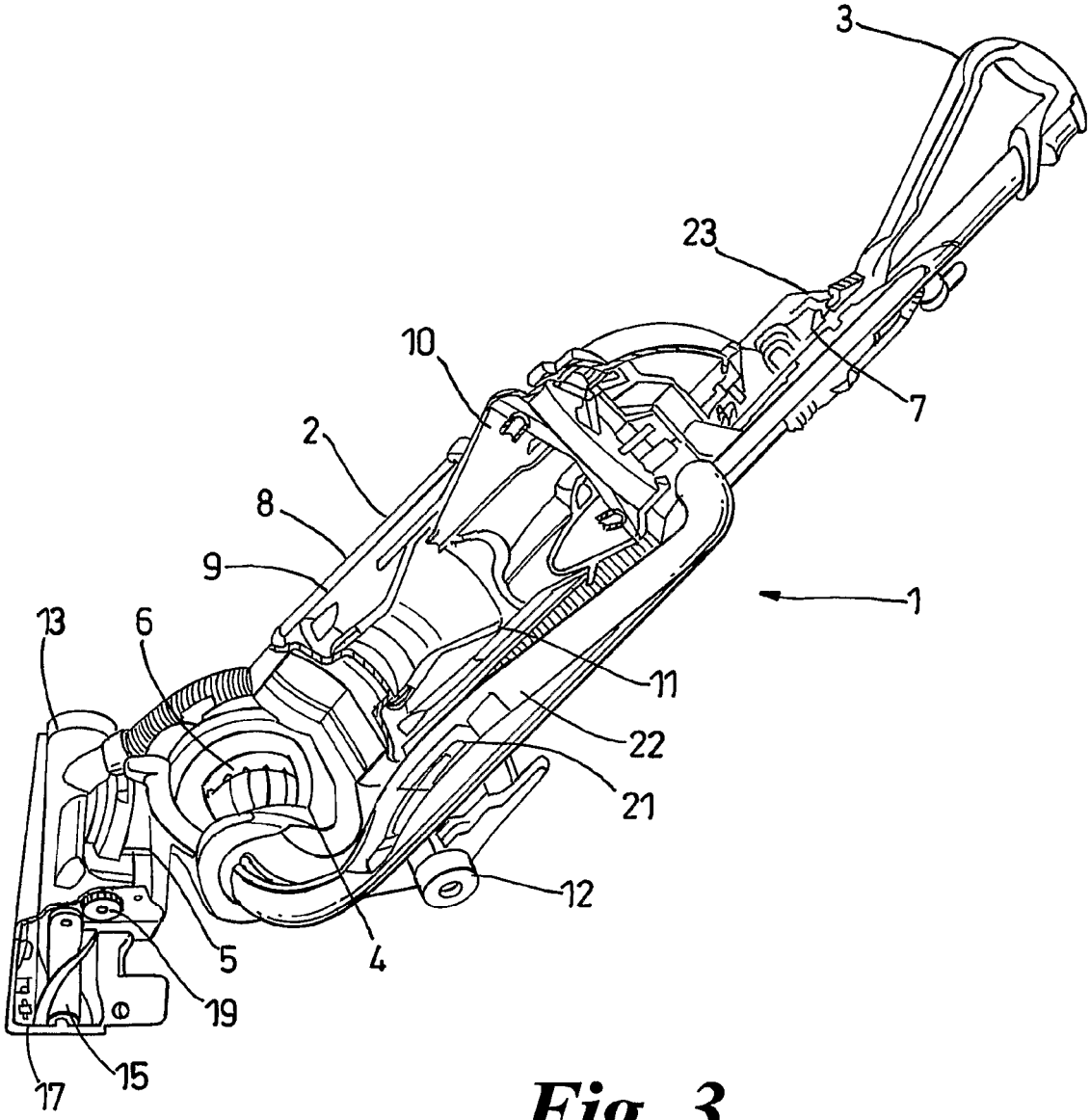
FIG. 3 is a perspective view, partly cut away, of the appliance of FIG. 1 in a mode of use.

With reference to FIGS. 1 and 3, the surface treating appliance is shown in the form of a vacuum cleaner and is indicated generally by the reference numeral 1. The vacuum cleaner 1 comprises a main body 2, a user-operable handle 3 and a large roller 4 for rolling the cleaner along a floor surface.

As viewable in FIG. 3, the roller 4 houses a fan 5 and a motor 6 for driving the fan. The motor 6 and fan 5 together generate suction for drawing a fluid, such as air, into the apparatus. The motor 6 and fan 5 may be arranged to rotate with the roller 4 or may be constrained so that the roller rotates with respect to them. A switch in the form of a user-operable button 7 is provided on the upper portion of the main body 2 and is arranged so that, when the button is pushed, the motor 6 is energised. The motor may also be de-energised by means of this button 7.

The main body 2 also houses separating apparatus 8 for separating dirt, dust and other debris from a dirty airflow drawn into the machine by the fan 5 and motor 6. In this embodiment, the separating apparatus 8 is cyclonic, in which the dirt and dust is spun from the airflow. The cyclonic separating apparatus 8 comprises two stages of cyclone separation arranged in series with one another. The first stage is a cylindrically-walled chamber 9 and the second stage comprises a set 10 of tapering, substantially frusto-conically shaped chambers arranged in parallel with one another. Airflow is directed tangentially into the upper part of a first cyclonic chamber 9. Larger debris and particles are removed and collected in the first cyclonic chamber 9. The airflow then passes through a shroud 11 to the set 10 of smaller frusto-conically shaped cyclonic chambers. Finer dust is separated by these chambers and the separated dust is collected in a common collecting region. The second set 10 of separators can be upright, i.e. with their fluid inlets and outlets at the top and their dirt outlets at the bottom, or inverted, i.e. with their fluid inlets and outlets at the bottom and their dirt outlets at the top. The nature of the dust separating apparatus 8 is not material to the present invention.

The main body 2 also houses filters (not visible in these drawings) for trapping fine particles in the cleaned airflow. These filters remove any fine particles of dust which have not already been removed from the airflow by the separating apparatus. A first filter, called a pre-motor filter, is provided before the motor 6 and fan 5. A second filter, called a post-motor filter, is provided after the motor 6 and fan 5. Where the motor 6 for driving the suction fan 5 has carbon brushes, the post-motor filter also serves to trap any carbon particles emitted by the brushes. Clean air is then expelled to the atmosphere. The roller 4 permits the cleaner to be maneuvered easily along a floor surface. However, the roller 4 may not provide sufficient support for the cleaner when the main body 2 is in the vertical, or substantially vertical position. To this end, a support assembly 12 is provided.

The handle 3 extends upwardly from the rear part of the main body 2. When the cleaner 1 is in the position shown in FIG. 1, it can be used in a cylinder mode, in which case the handle 3 may be released and used as a hose and wand assembly. A changeover valve on the main body 2 automatically connects the dust separating apparatus 8 to the wand and hose assembly so that cleaner can be used in this cylinder mode for above the floor cleaning. Air is drawn into the cleaner through the end of the wand which can be released from the cleaner for appropriate manipulation.

When the cleaner 1 is to be used in conventional upright mode, the user reclines the main body 2. The support assembly 12 is arranged to be retractable when the main body 2 of the cleaner 1 is reclined for upright cleaning, such as is shown in FIG. 3.

Figure 2:
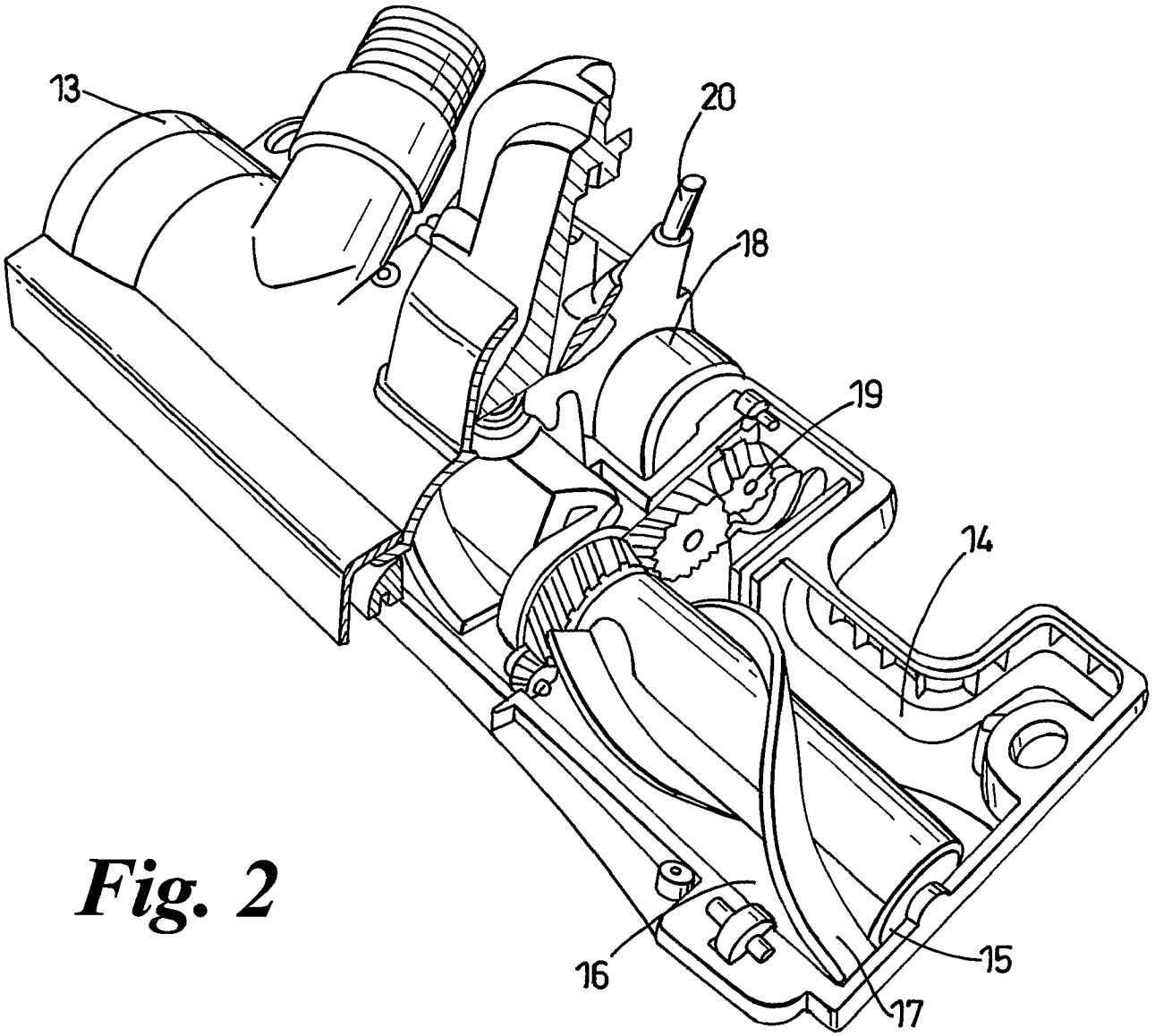
FIG. 2 is a perspective view, partly cut away, of the surface-treating head of the appliance of FIG. 1.

A cleaner head 13 serves to treat the floor surface in the upright cleaning mode, and is shown in more detail in FIG. 2. In this embodiment, it comprises a chamber 14 for supporting an agitator in the form of a brush bar 15. The lower, floor-facing side of the chamber 14 has an air inlet slot 16 and the brush bar 15 is rotatably mounted in the chamber such that bristles 17 on the brush bar can protrude through the inlet slot and can agitate the floor surface over which the cleaner head is made to pass. The brush bar 15 is rotatably driven by a dedicated motor 18 positioned inside the cleaner head. A system of gears 19 connects the motor 18 to the brush bar 15 to provide drive.

An electrical connection 20 is provided to the brush bar motor 18 in order to energise it. In accordance with the invention, the cleaner head 13 is arranged so that, when the main vacuum motor 6 is switched on, the motor 18 in the cleaner head is also energised, so that the brush bar 15 is driven automatically on start-up of the cleaner.

The partly cut-away view of FIG. 3 shows control circuitry 21 that may be employed in order to effect automatic driving of the brush bar 15 on start-up. The control circuitry 21 is located within a duct 22 forming part of the suction airflow path, after the dust separating apparatus 8 and upstream of the main vacuum motor 6 located in the roller 4. Positioning of the circuitry 21 in the airflow ensures that the electronic components are cooled adequately.

A user can also select energisation and de-energisation of the brush bar motor 18 by means of a switch, which is provided on the machine in the form of a depressible button 23. The button 23 is conveniently located in an easily visible location at the top of the main body 2 of the machine. The button 23 may be employed to switch off the motor 18 for the brush bar 15. For example, the user may wish to clean an uncarpeted surface, in which case the brush bar 15 need not be employed. Alternatively, the user may wish to use the hose and wand assembly for cleaning.

In this embodiment, the button 23 is provided adjacent the button 7 by which the user switches on the cleaner 1 and energises the main vacuum motor 6 used to generate suction airflow. The buttons 7, 23 may have visual indicia on them to indicate their respective functions.

The control circuitry 21 is arranged to reset itself so that, when the main vacuum motor 6 is switched off and subsequently re-energised, the brush bar motor 18 automatically starts up again and rotates the brush bar 15.

Although the invention has just been described with reference to an upright cleaner, it is also applicable to cylinder cleaners, which have a surface-treating head located at the end of the hose and wand assembly. The cleaner head may also be provided in the form of a floor tool, which may be fitted to the end of a hose and wand assembly of a vacuum cleaner of either type.

Of course, further variations may be made without departing from the scope of the invention. For example, there need not be a physical electrical connection between the main body of the appliance and the cleaner head. Wireless signals may be employed to switch on the dedicated brush bar motor, in which case the brush bar motor may be conveniently energised by a dedicated energy source, such as a battery pack.

While the illustrated embodiment shows a vacuum cleaner in which ducts carry airflow, it will be appreciated that the invention can be applied to vacuum cleaners which carry other fluids, such as water and detergents.

The invention claimed is:

1. A cleaner head for a cleaning appliance comprising a dirt and dust separating apparatus, a motor configured to drive a fan for generating suction air flow and a control circuit comprising a selectively-operable switch for energizing the motor, the cleaner head comprising a driveable agitator configured to be automatically driven each time a user switches on the motor and capable of being de-energized while the motor is energized subsequent to thus being automatically driven, the control circuit being configured to reset the driveable agitator each time the motor is turned off and switched on such that the driveable agitator is automatically driven each time the user switches on the motor.

2. A cleaner head as claimed in claim 1, further comprising an agitator motor for driving the agitator.

3. A cleaner head as claimed in claim 2, further comprising a switch for selective energizing and de-energizing of the agitator motor subsequent to the agitator thus being automatically driven when the user switches on the motor.

4. A cleaner head as claimed in claim 1, 2 or 3, in which the agitator comprises a rotatable brush bar.

5. A cleaning appliance comprising a main body housing a dirt and dust separating apparatus, a motor configured to drive a fan for generating suction air flow, a control circuit comprising a selectively-operable switch for energizing the motor, and a cleaner head having a driveable agitator configured to be automatically driven each time a user switches on the motor and capable of being de-energized while the motor is energized subsequent to the agitator thus being automatically driven, the circuit being configured to reset the driveable agitator each time the motor is turned off and switched on such that the driveable agitator is automatically driven each time the user switches on the motor.

6. A cleaning appliance as claimed in claim 5, further comprising an agitator motor for driving the agitator.

7. A cleaning appliance as claimed in claim 6, further comprising an agitator motor switch for selective energizing and de-energizing the agitator motor subsequent to the agitator thus being automatically driven when the user switches on the motor.

8. A cleaning appliance as claimed in claim 7, in which the agitator motor switch is located on the main body.

9. A cleaning appliance as claimed in claim 6, 7 or 8, in which the agitator motor is located in the cleaner head.

10. A cleaning appliance as claimed in claim 5, 6, 7 or 8, in which the agitator comprises a rotatable brush bar.

11. A vacuum cleaner comprising the cleaning appliance as claimed in claim 5, 6, 7, or 8.

12. A control circuit for a cleaning appliance comprising a dirt and dust separating apparatus, a motor arranged to drive a fan for generating suction air flow and a cleaner head having a driveable agitator which is capable of being de-energized while the motor is energized, the circuitry comprising a user-operable switch for energizing the motor, the circuitry being configured to reset the driveable agitator each time the motor is turned off and switched on such that the driveable agitator is automatically driven each time a user switches on the motor.

13. A cleaning appliance as claimed in claim 9, in which the agitator comprises a rotatable brush bar.

14. A vacuum cleaner comprising the cleaning appliance as claimed in claim 9.

15. A vacuum cleaner comprising the cleaning appliance as claimed in claim 10.

* * * * *